US006600165B1

(12) United States Patent
Doe et al.

(10) Patent No.: US 6,600,165 B1
(45) Date of Patent: Jul. 29, 2003

(54) SELF-PROPELLED INFRARED EMISSION AERIAL TARGET

(76) Inventors: Pascal Doe, 1 D rue Saint Médéruc, 7800 Versailles (FR); Herve Guidetti, Quartier Gribeauval - STAT/ART4, 78013 Versailles Satory (FR); Gilles Thavot, 80, rue des chantiers, 78000 Versailles (FR); Eric Rantet, Chemin de la Plaine à Popinet, 91590 Mondeville (FR)

( * ) Notice: Subject to any disclaimer, the term of this patent is extended or adjusted under 35 U.S.C. 154(b) by 0 days.

(21) Appl. No.: 09/330,133

(22) Filed: Jun. 11, 1999

(51) Int. Cl.[7] ..... G01J 1/00
(52) U.S. Cl. ..... 250/495.1; 244/12
(58) Field of Search ..... 250/203, 495.1; 273/348, 360

(56) References Cited

U.S. PATENT DOCUMENTS

| | | | | | |
|---|---|---|---|---|---|
| 3,658,279 | A | * | 4/1972 | Robertson | 244/53 R |
| 3,857,239 | A | * | 12/1974 | Brock et al. | 60/204 |
| 3,972,490 | A | * | 8/1976 | Zimmermann et al. | 244/12 |
| 4,044,683 | A | | 8/1977 | Ostroff | |
| 4,109,885 | A | * | 8/1978 | Pender | 244/7 |
| 4,428,583 | A | * | 1/1984 | Feagle | 273/348.1 |
| 4,607,849 | A | | 8/1986 | Smith et al. | |
| 5,317,163 | A | * | 5/1994 | Obikircher | 250/495.1 |
| 5,620,152 | A | * | 4/1997 | Sargent | 244/3.12 |

FOREIGN PATENT DOCUMENTS

| | | | |
|---|---|---|---|
| EP | 0 568 436 A | | 11/1993 |
| WO | WO 97/27446 | | 7/1997 |
| WO | WO-97/27446 | * | 7/1997 |

OTHER PUBLICATIONS

"Beechcraft MQM–107 Target System," Aviation Week, vol. 119, Nov. 7, 1983, pp. 70–71.

Ropelewski, R., "Northrop Begins Building Its NV–144 Target Drone," Aviation Week, vol. 118, Jan. 3, 1983, pp. 41–42.

* cited by examiner

*Primary Examiner*—John R. Lee
*Assistant Examiner*—David A. Vanore
(74) *Attorney, Agent, or Firm*—Oliff & Berridge, PLC

(57) ABSTRACT

A self-propelled infrared emission aerial target has an aircraft- or a missile-shaped body and a nose, wings and/or control surfaces, a system for feeding fuel and oxidizer to a combustion chamber in which combustion gases are produced and for supplying the combustion gases to a propulsion nozzle, and an infrared radiation emitter. The target has at least one conduit connecting the combustion chamber or propulsion nozzle of the propulsion system to a nose, wing and/or control surface of the target, or to an outside element attached thereto.

20 Claims, 3 Drawing Sheets

SELF-PROPELLED INFRARED EMISSION AERIAL TARGET

BACKGROUND OF THE INVENTION

1. Field of Invention

The present invention relates to the field of moving aerial targets, in particular a self-propelled infrared emission aerial target having a body, a propulsion system, and an infrared radiation emission system.

2. Description of Related Art

Self-propelled aerial targets are used particularly within the framework of missile development testing or troop training and in the framework of decoying to escape a missile attack.

Some of these missiles are of the infrared guidance type, namely they seek the target by detecting its infrared signature. Then, their control surfaces are moved to guide them on a given trajectory leading to the destruction of the target.

For development of such missiles, the target described in Patent WO 9727446, which has a fuselage, propulsion systems, and infrared radiation emitters, is known. The infrared radiation emitters are comprised of a heat entity which is composed of an oil burner that heats a heat-conducting surface so that the latter emits infrared radiation.

This entity has a primary chamber having air inlets under dynamic pressure and air outlets through which the air can be evacuated to the atmosphere. The burner is in a second chamber which receives air from a first chamber and contains the burner. The burner flame heats a surface in a combustion chamber that also has a lattice enabling the flame to heat the entire surface, a mechanism for controlling the flowrate of combustion gas heating the heat-conducting surface, and also hot gas outlets located near the air inlets.

Although it is efficient, such a target has a number of drawbacks.

The first of them relates to the safety and reliability of the device. Actually, if the propulsion system does not work during the launching, while the infrared radiation emitters are working, the device may be detected by a missile and destroyed while on the ground, bringing about substantial damage and body injuries for the personnel in charge of the launching.

The second of them relates to the quality of the representation of an aircraft.

Starting from a target such as that described in Patent WO 9727446, the infrared diagram simulates in band II, namely in the lock-on range of an infrared homing device, and in band III, namely in the aircraft silhouette acquisition range, and the infrared diagram is ovoid as shown in FIG. 1.

However the infrared diagram of a real aircraft is cardioid, as shown in FIG. 2.

Thus, it can be seen that representation of the infrared signature of an aircraft is only approximative with such a target.

SUMMARY OF THE INVENTION

One of the goals of the invention is to overcome these problems by providing a safe, reliable, self-propelled target that considerably improves the infrared representativeness of the target, coming closer to that of a real aircraft.

The present invention is directed to a self-propelled, preferably jet-propelled, infrared emission aerial target having an aircraft- or missile-shaped body comprising: at least one propulsion system comprising a combustion chamber in which gases are produced and a propulsion nozzle to which combustion gases produced by the combustion chamber are supplied to propel the target; an infrared radiation emitter at an external surface of the target; and a conduit such as a pipe connecting the combustion chamber or the propulsion nozzle to the infrared radiation emitter.

In a preferred embodiment, the target contains more than one propulsion system, for example, the target can contain two propulsion systems. By using more than one propulsion system, the target may have more thrust to fly faster and/or may provide for more heat for infrared detection.

In addition, the present invention is directed to a self-propelled, preferably jet-propelled, infrared emission aerial target having an aircraft- or missile-shaped body and a nose and/or wings or control surfaces, an infrared radiation emitter, and at least one propulsion system comprising one or more conduits for feeding fuel and preferably oxidizer to a combustion chamber in which combustion gases are produced and for supplying the gases to a propulsion nozzle. The target may have at least one conduit such as a pipe connecting the combustion chamber or propulsion nozzle of the propulsion system to the nose and/or to one or more wing(s) and/or one or more control surface(s) of the target, or to one or more outside element(s) attached thereto.

In embodiments, a pipe connects the combustion chamber or propulsion nozzle of the propulsion system to a chamber located in the nose or in a wing or a control surface, or to a chamber located in an outside element attached to the target.

In particular embodiments, the target has a first pipe connecting the combustion chamber or the nozzle of the propulsion system to a chamber located in the nose of the target and a second pipe connecting the combustion chamber of the propulsion system to at least one chamber located in one of the wings or control surfaces of the target. The first and second pipes can be independent or have a common part.

In embodiments, the at least one chamber located in one of the wings or control surfaces is located at its leading edge.

In embodiments, the at least one chamber comprises a steel pipe cast in silicone graphite or cast in a high-emissivity material, or made of a metal or composite material.

In embodiments, at least one part of the chamber located in the nose is made of oxidized steel coated with graphite or cast in silicone graphite. At least one part of the chamber can also be cast in another high-emissivity material or a composite material.

In embodiments, the combustion chamber is connected to a nozzle that can be made of oxidized steel coated with graphite or cast in silicone graphite or cast in another high-emissivity material or a composite material.

In embodiments, the propulsion nozzle can have a diverging-converging section, the pipe terminating in the diverging-converging section of the nozzle.

The present invention is also directed to a method of representing the infrared signature of an aircraft or missile with the aid of a self-propelled aerial target having an aircraft- or missile-shaped body and having a nose and/or wings and/or control surfaces, a propulsion system comprising one or more conduits for feeding fuel and preferably oxidizer to a combustion chamber in which propulsion gases are produced, and an infrared radiation emitter, in which some of the propulsion gases heat all or part of the external surfaces of the target and/or attachments on the target to a temperature such that they emit infrared radiation.

BRIEF DESCRIPTION OF THE DRAWINGS

Other advantages and characteristics will appear in the description of particular embodiments of the invention in relation to the attached figures, in which:

FIG. 3A represents a top view of the target and FIG. 3B represents a side view of the target.

DETAILED DESCRIPTION OF EMBODIMENTS

Figure 2:
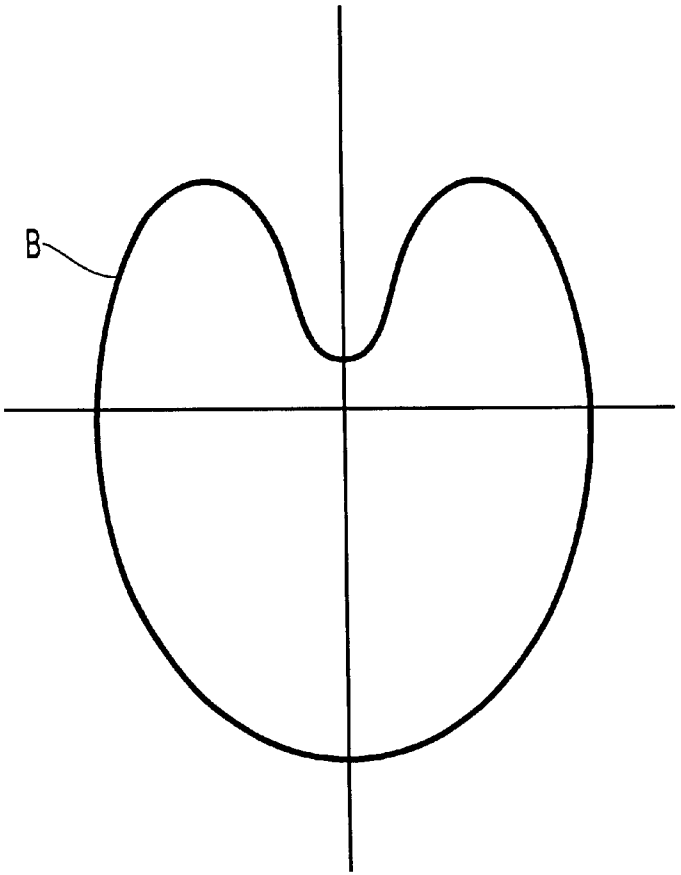
FIG. 2 is a diagram of an infrared heat signature of an aircraft and that of a target according to the invention.
Figure 1:
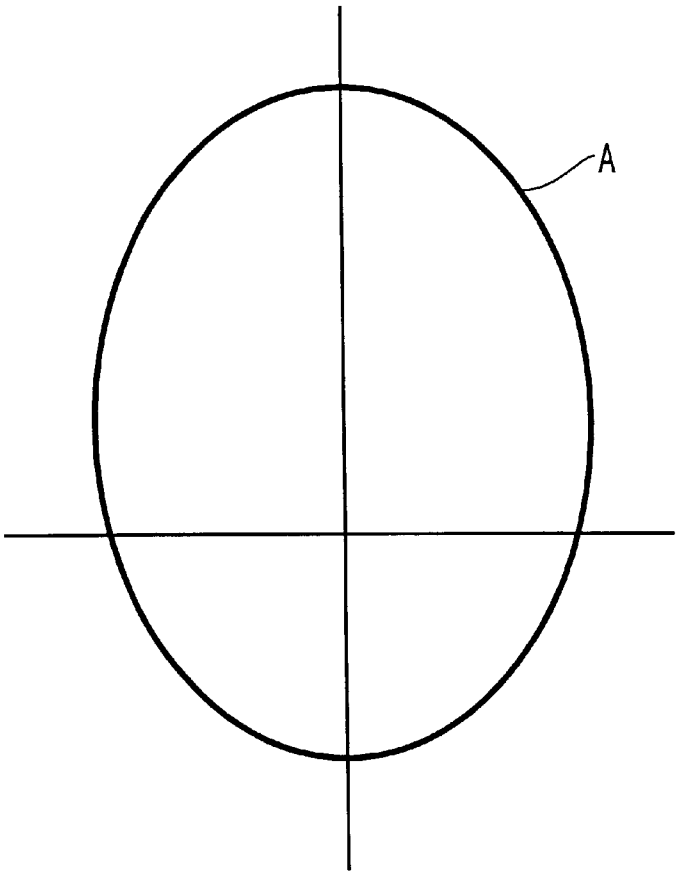
FIG. 1 is a diagram of an infrared heat signature of self-propelled aerial targets according to the prior art.
Figures 3A, 3B:
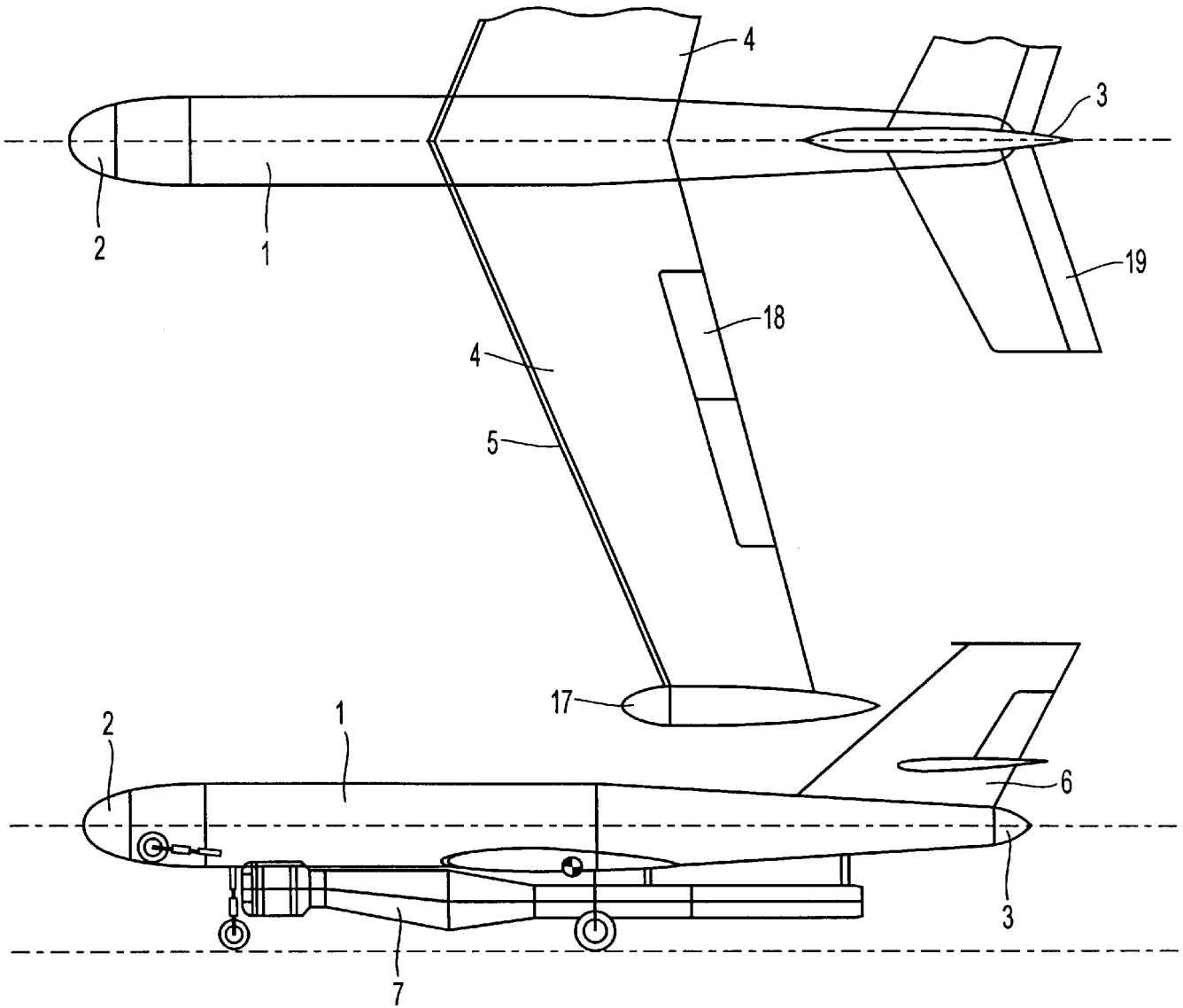
FIGS. 3A and 3B represent the outside of an aerial target according to one embodiment of the invention.

According to an embodiment of the invention, as demonstrated in FIGS. 3A–B, the self-propelled aerial target is aircraft-shaped. It has a fuselage 1 with a nose 2 and a tail 3, wings 4 with leading edges 5, and a tail assembly 6.

Figure 4:
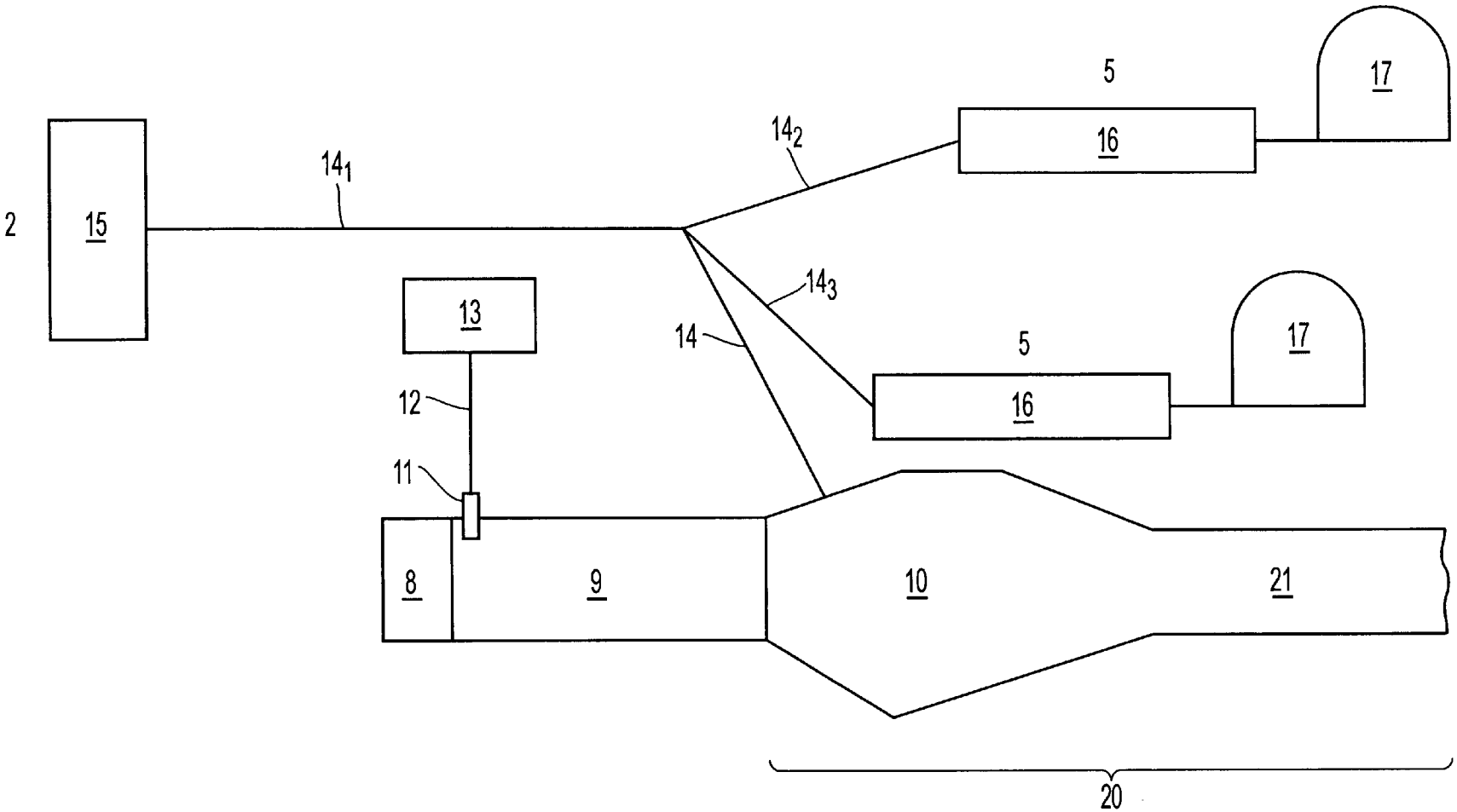
FIG. 4 is a diagram of a propulsion system and an infrared emitter.

A propulsion system 7 is disposed under fuselage 1 and attached thereto. As demonstrated in FIG. 4, the propulsion system has an air inlet 8, a combustion chamber 9, and a nozzle 20 for discharging the combustion gases.

A fuel injector 11 located in combustion chamber 9 is connected by a supply line 12 to a fuel tank 13 located inside fuselage 1. Also, a pipe 14 that divides into three secondary pipes $\mathbf{14}_1$, $\mathbf{14}_2$, and $\mathbf{14}_3$ connects propulsion nozzle 20 to a first chamber 15 located in the nose 2 of fuselage 1, to two other second chambers 16 each located in the leading edge 5 of one of the two wings 4, and two other chambers 17 located at the ends of the wings and forming outer elements attached to the target.

Nozzle 20 is comprised of a divergent-convergent section 10 followed by a cylindrical part 21. This shape allows a temperature and pressure gradient particularly suited to the infrared emission of the nozzle and to gas extraction to be established. The increase in diameter allows improved infrared radiation in band II while the propulsion gases are extracted at the points with the best temperature and pressure ratio; in this case, these points are located near the end of the diverging section.

Materials from which the main equipment items of the target according to the invention are preferably made include but are not limited to:

- fuselage 1: fiberglass, carbon fiber, or Kevlar fiber composite, or metal,
- chamber 15: oxidized steel with graphite externally coated thereon,
- each of the two chambers 16: steel pipe cast in a silicon graphite resin,
- chambers 17: external oxidized steel elements for final recovery of hot gases,
- the nozzle 20: oxidized steel coated with graphite on its external surface.

In addition, pipe 14 may be heat-insulated such as with Kherlan fibers to prevent heat loss.

Moreover, control surfaces 18 and 19 are preferably activated by a remote-control system.

The operation of the aerial target according to the embodiment shown in the drawings described may be as follows:

Takeoff of the target may be accomplished in the same manner as that of classical targets.

As soon as it takes off, the propulsion system produces combustion gases, the static pressure of which is increased by the presence of a diverging section of the nozzle 20.

Most of the combustion gas is ejected rearward, thus serving for propulsion, while some of the gas, due to overpressure, escapes through pipe 14 and reaches chambers 15 and 16 before being evacuated into the environment. The passage of the combustion gases into chambers 15 and 16 heats the materials of which the latter are made to a temperature in such a way that they emit infrared radiation representative of the infrared signature of an aircraft.

Numerous modifications may be made to the embodiment described without departing from the framework of the invention. For example, the tail assembly of the target can also be heated by combustion gases and can emit infrared radiation. In addition, different materials can be used, particularly for emission of infrared radiation in order to compensate the radiating surface area coefficient by the temperature coefficient of the emission surface.

In addition, the propulsion system can, for example, be a ramjet, turboprop or other engine.

Targets according to the invention can have increased reliability and optimized mass by comparison to that described in patent WO 9727446 because of the use of a single combustion chamber for propulsion and infrared emission at various points on its surface, and optimized infrared radiation emission autonomy because it is combined with propulsion.

What is claimed is:

1. An infrared emission aerial target comprising: (a) an aircraft- or missile-shaped body having at lease one of a nose, a wing and a control surface; (b) propulsion means, for propelling the aerial target, comprising means for feeding fuel to a combustion chamber in which combustion gases are produced and means for supplying combustion gases to a propulsion nozzle of the aerial target; and (c) infrared radiation emission means located in at least one of the nose, the wing, and the control surface or in an outside element attached to the target, said target having at least one conduit connecting said combustion chamber or propulsion nozzle of the propulsion means to the infrared radiation emission means.

2. The aerial target according to claim 1, wherein said conduit connects said combustion chamber or propulsion nozzle of the propulsion means to a chamber located in the nose or a wing or a control surface, or to a chamber located in an outside element attached to the target.

3. The aerial target according to claim 2, having a first conduit connecting the combustion chamber or the propulsion nozzle of the propulsion means to a chamber located in the nose of the target and having a second conduit connecting the combustion chamber of the propulsion means to at least one chamber located in at least one of the wing or the control surface of the target.

4. The aerial target according to claim 3, said first and second conduits having a common part.

5. A self-propelled infrared emission aerial target having an aircraft- or missile-shaped body, comprising:

(a) a propulsion system comprising a combustion chamber in which gases are produced and a propulsion nozzle to which combustion gases produced in the combustion chamber are supplied to propel the target;

(b) an infrared radiation emitter at an external surface of the target; and (c) a conduit connecting at least one of the combustion chamber and the propulsion nozzle to the infrared radiation emitter.

6. The aerial target according to claim 5, wherein said target has at least one of a nose, a wing, a control surface and a tail.

7. The aerial target according to claim 6, wherein said infrared radiation emitter is in at least one of said nose, said wing, said control surface, said tail and an outside element attached to the target.

8. The aerial target according to claim 7, wherein said outside element is attached to a wing of the target.

9. The aerial target according to claim 5, wherein said infrared radiation emitter is a chamber located at an external surface of the target.

10. The aerial target according to claim 6, wherein a first conduit connects at least one of the combustion chamber and the propulsion nozzle to an infrared radiation emitter located in the nose of the target and a second conduit connects the combustion chamber to at least one infrared radiation emitter located in at least one of the wing and control surface of the target.

11. The aerial target according to claim 10, wherein said first and second conduits have a common part.

12. The aerial target according to claim 5, further comprising a fuel source and at least one conduit whereby fuel and oxidizer are fed to the combustion chamber.

13. The aerial target according to claim 5, wherein the propulsion nozzle comprises a diverging-converging section.

14. The aerial target according to claim 13, wherein said conduit connects the infrared radiation emitter to the diverging-converging section of the propulsion nozzle.

15. The aerial target according to claim 6, wherein said infrared radiation emitter is located in a leading edge of at least one of said wing and said control surface.

16. The aerial target according to claim 9, wherein said chamber comprises oxidized steel coated with graphite on its external surface.

17. A method for representing the infrared signature of an aircraft or missile using a self-propelled aerial target having an aircraft- or missile-shaped body, comprising removing a portion of the combustion gases used for propulsion from a propulsion system of the target to heat at least a portion of the external surface of the target to a temperature in such a way that said external surface emits infrared radiation.

18. The method according to claim 17, wherein said target has at least one of a nose, a wing, a control surface and a tail.

19. The method according to claim 18, wherein said external surface is located in at least one of said nose, said wing, said control surface, said tail, and an outside element attached to the target.

20. The method according to claim 18, wherein said external surface is in a leading edge of at least one of said wing and said control surface.

* * * * *

UNITED STATES PATENT AND TRADEMARK OFFICE

CERTIFICATE OF CORRECTION

PATENT NO. : 6,600,165 B1
DATED : July 29, 2003
INVENTOR(S) : Pascal Doe et at al.

It is certified that error appears in the above-identified patent and that said Letters Patent is hereby corrected as shown below:

Title page,
Insert item:

-- [30] Foreign Application Priority Data

November 13, 1998 [FR] France ……..98.14280 --

Signed and Sealed this

Twentieth Day of April, 2004

JON W. DUDAS
*Acting Director of the United States Patent and Trademark Office*